US007401679B2

(12) United States Patent
Ipsen

(10) Patent No.: US 7,401,679 B2
(45) Date of Patent: Jul. 22, 2008

(54) ADAPTOR FOR MOUNTING A SOUND TUBE IN AN EARPIECE

(75) Inventor: Klaus Sommer Ipsen, Vanlose (DK)

(73) Assignee: GN Resound A/S, Taastrup (DK)

( * ) Notice: Subject to any disclaimer, the term of this patent is extended or adjusted under 35 U.S.C. 154(b) by 316 days.

(21) Appl. No.: 10/778,716

(22) Filed: Feb. 13, 2004

(65) Prior Publication Data

US 2005/0006171 A1 Jan. 13, 2005

(30) Foreign Application Priority Data

Feb. 14, 2003 (DK) ..... 2003 00230

(51) Int. Cl.
*H04R 25/02* (2006.01)

(52) U.S. Cl. ..... 181/129; 181/128; 181/130; 181/135; 381/328; 285/33; 124/10; 24/437

(58) Field of Classification Search ..... 181/130, 181/135, 128, 129; 381/328; 285/33; 124/10; 24/437

See application file for complete search history.

(56) References Cited

U.S. PATENT DOCUMENTS

| | | | | | |
|---|---|---|---|---|---|
| 3,918,550 | A | | 11/1975 | Milani | 181/135 |
| 4,006,796 | A | * | 2/1977 | Coehorst | 181/130 |
| 4,090,760 | A | * | 5/1978 | Furey | 439/269.1 |
| 4,311,206 | A | | 1/1982 | Johnson | 181/135 |
| 4,375,016 | A | * | 2/1983 | Harada | 181/135 |
| 4,381,830 | A | * | 5/1983 | Jelonek et al. | 181/129 |
| 4,977,976 | A | | 12/1990 | Major | 181/130 |
| 5,002,151 | A | * | 3/1991 | Oliveira et al. | 181/130 |
| 5,278,360 | A | * | 1/1994 | Carbe et al. | 181/135 |
| 5,488,205 | A | * | 1/1996 | Major | 181/129 |
| 5,742,692 | A | * | 4/1998 | Garcia et al. | 381/328 |
| 5,764,844 | A | * | 6/1998 | Mendes | 385/135 |
| 5,983,399 | A | * | 11/1999 | Falco et al. | 2/209 |
| 6,006,857 | A | * | 12/1999 | Leight et al. | 181/135 |
| 6,129,174 | A | * | 10/2000 | Brown et al. | 181/135 |
| 6,310,961 | B1 | * | 10/2001 | Oliveira et al. | 381/328 |
| RE38,351 | E | * | 12/2003 | Iseberg et al. | 381/380 |

FOREIGN PATENT DOCUMENTS

DE 20114121 U1 8/2001

* cited by examiner

*Primary Examiner*—Lincoln Donovan
*Assistant Examiner*—Jeremy Luks
(74) *Attorney, Agent, or Firm*—Bingham McCutchen LLP

(57) ABSTRACT

The present invention relates to mounting of a sound tube inside a shell of a hearing aid. The invention provides a sound tube adaptor, a tool for insertion of the adaptor and a method for attaching a sound tube to a shell, the sound tube adaptor facilitating attachment of a sound tube to a shell, having a first end for attachment to one end of a sound tube and a second end that is adapted to be received inside the shell in a hole in the shell in such a way that the adaptor and the sound tube extend inside the shell from the hole towards the entrance of an ear canal of a user when the shell is positioned in the ear canal.

18 Claims, 10 Drawing Sheets

ADAPTOR FOR MOUNTING A SOUND TUBE IN AN EARPIECE

This application claims priority to Denmark patent application No. PA 2003 00230, filed on Feb. 14, 2003, the entire disclosure of which is expressly incorporated by reference herein.

FIELD OF THE INVENTION

The present invention relates to mounting of a sound tube inside a shell of a hearing aid.

PRIOR ART

Behind-the-ear hearing aids in which a sound tube conducts sound generated by the receiver of the hearing aid into the ear canal are well known in the art. In order to position the sound tube securely and comfortably in the ear canal, a shell is provided for insertion into the ear canal of the user. Typically, the shell is individually adapted to the human anatomy of the ear of the user.

So-called "open" shells are generally preferred in order to affect the ear canal as little as possible by avoiding blockage of the ear canal, i.e. the occlusion effect. This also assists in maintaining the natural hearing capacity of the user.

SUMMARY OF THE INVENTION

It is desirable to provide a shell that facilitates attachment of the sound tube to the shell and that also has a vent for at least partially reducing the occlusion effect. Further, the vent assists in maintaining the natural hearing capacity of the user.

According to a first aspect of the invention, a sound tube adaptor is provided that may be attached to a sound tube at one end and inserted into a hole in a shell at the other end. After insertion, the adaptor and the sound tube extend inside the shell from the hole towards the entrance of an ear canal of a user when the shell is positioned in the ear canal.

After insertion, the adaptor and the hole may co-operate to provide at least one vent.

According to a second aspect of the invention, a shell is provided having a hole for receiving and holding a sound tube adaptor with a sound tube. The adaptor and the hole may co-operate to provide at least one vent when the adaptor is inserted in the shell hole.

According to a third aspect of the invention, a method of attaching a sound tube to a shell is provided comprising the steps of attaching one end of the sound tube to the above-mentioned adaptor, inserting the other end of the sound tube into a hole in the shell from the outside of the shell, passing the sound tube through the hole, and mounting the adaptor in the hole whereby the sound tube is attached to the shell.

According to a fourth aspect of the invention, a tool is provided for insertion of the adaptor into the hole of the shell.

The tool may have a first protrusion that is adapted for insertion into an output opening of the adaptor, and a second protrusion wherein the space between the first and second protrusions is adapted to accommodate a wall of the adaptor.

The tool may further have a center hole for checking that the adaptor may be used with a particular shell, the center hole having a diameter so that the cross-section of the end of the particular shell with the hole can cover the center hole when the shell has a sufficient size for accommodating an adaptor.

Still further an end of the tool may be dimensioned so that the end can enter the shell hole when the shell has a sufficient size for accommodation of an adaptor.

The sound tube adaptor may have a first end of a generally cylindrical shape extending along a longitudinal axis. Preferably, a bead is provided at the first end for insertion into the sound tube for secure attachment by resilience of the sound tube.

The sound tube adaptor may have a second end for attachment to the shell with a generally cylindrical shape, or a generally tapered cylindrical shape with a cross-section that increases or decreases along the longitudinal axis of the adaptor. In one embodiment, the cross-section of the adaptor at the second end has a cross-section that is less than the corresponding cross-section of the shell hole, so that an area of the hole, after insertion of the adaptor, may function as at least one vent. The at least one vent may constitute a single opening in the shell with the attached adaptor, or, the at least one vent may constitute a plurality of separate openings in the shell with the attached adaptor.

Further, the sound tube adaptor may have at least one first flange at the second end for abutment with the outer surface of the shell after insertion of the adaptor in the shell hole.

At least one second flange may be positioned at a distance from the at least one first flange along the longitudinal axis. The distance may be approximately equal to the thickness of the shell hole so that the at least first flange abuts the outer surface of the shell and the at least second flange abuts the inner surface of the shell after insertion of the adaptor in the shell hole.

Further, the at least second flange may be tapered along the longitudinal axis towards the first end whereby the adaptor may be fixed in the shell hole by a snap fit coupling.

In a preferred embodiment, the at least second flange is adapted to engage with protrusions provided in the shell at the hole for prevention of rotational movement of the adaptor in the hole.

The sound tube adaptor may further comprise an end plate at the second end having a vent hole.

In a preferred embodiment, a sound tube adaptor further contains weakenings at the second end allowing removal of part of the adaptor for obstruction of a smaller part of the hole in the shell after insertion of the adaptor.

Preferably, the hole and the sound adaptor are designed so that the sound adaptor fits in the hole in two different positions mutually angularly separated 180°. This adds flexibility to the system in that the shell may not be able to accommodate the adaptor and the sound tube in one of the positions, however in embodiments with an additional second position, this position may then be used.

In still another embodiment, the adaptor and the hole are designed so that the adaptor may be fitted into the hole in any arbitrary angular position further facilitating accommodation of the sound tube and the adaptor in the shell.

The shell may further comprise an end plate containing the hole. According to this embodiment, an appropriate shell may be individually produced for the user or, an appropriate standard size may be selected, and the dispenser may select an end plate with an appropriately sized and shaped hole. The end plate is fitted to the shell geometry and fixed to the shell in a way well known in the art of assembling CIC- and ITE-shells with a faceplate.

The adaptor and the sound tube may be integrated into one component for ease of manufacture and assembly.

In an embodiment with a separate adaptor and sound tube, individual adjustment of the distance from the adaptor to a first bend of the sound tube is facilitated. The sound tube may be cut at the desired length before attachment to the adaptor.

Although a shell for a behind-the-ear hearing aid has been mentioned above, it should be understood that the invention covers any shells requiring mounting of a sound tube, such as shells for completely-in-the-canal (CIC) hearing aids, for in-the-canal (ITE) hearing aids, for behind-the-ear (BTE) hearing aids, for earplugs for protection against noise with two-way communication means, for audio equipment, etc.

BRIEF DESCRIPTION OF THE DRAWINGS

Below, the invention will be further described and illustrated with reference to the accompanying drawings in which.

DETAILED DESCRIPTION OF PREFERRED EMBODIMENTS

Figure 1:
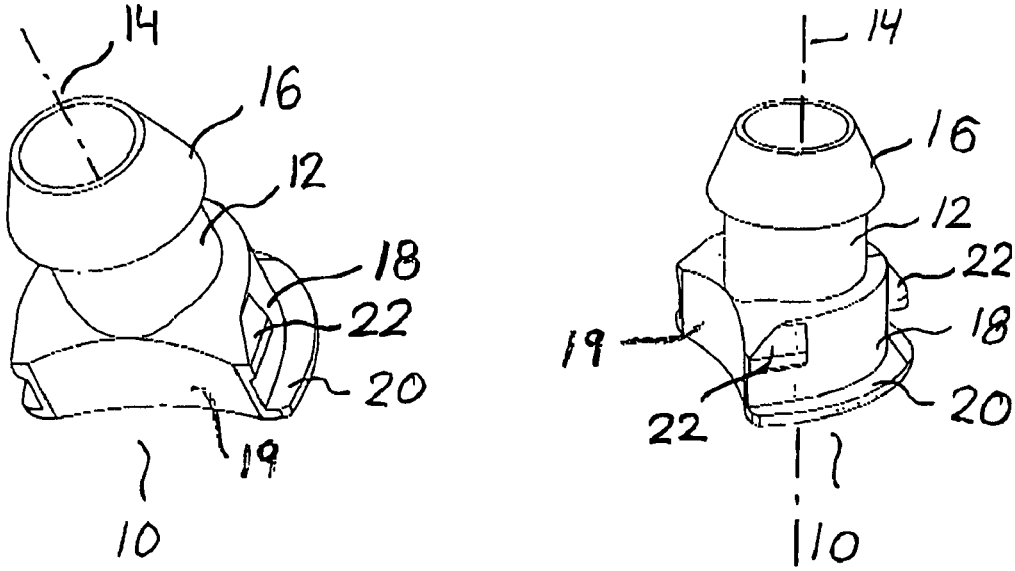
FIG. 1 is a perspective view of a first embodiment of the invention.

FIG. 1 shows a sound tube adaptor 10 according to the present invention. The sound tube adaptor 10 has a first end 12 of a generally cylindrical shape extending along a longitudinal axis 14. A bead 16 is provided at the first end 12 for insertion into the sound tube for secure attachment by resilience of the sound tube.

The sound tube adaptor 10 has a second end 18 for attachment to the shell with a generally cylindrical shape. A first flange 20 is provided at the second end 18 for abutment with the outer surface of the shell after insertion of the adaptor 10 in the shell hole. Further, at least one second flange 22 is positioned at a distance from the at least one first flange 20 along the longitudinal axis 14. The distance is approximately equal to the thickness of the shell hole so that the first flange 20 abuts the outer surface of the shell and each of the at least second flanges 22 abuts the inner surface of the shell after insertion of the adaptor 10 in the shell hole.

Figure 2:
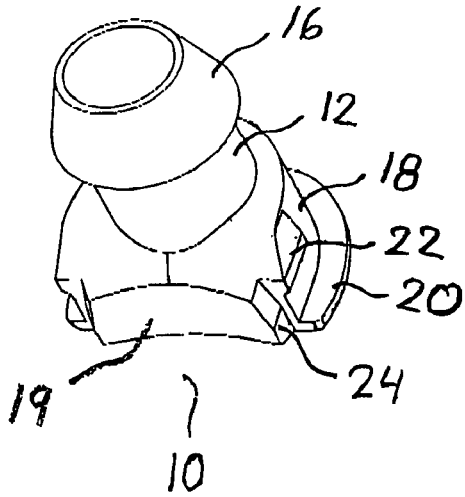
FIG. 2 is a perspective view of a second embodiment of the invention.

FIG. 2 shows another sound tube adaptor 10 according to the present invention, with a protrusion 24 extending from the main body of the adaptor 10 whereby the cross-section of the un-obstructed part of the hole in the shell providing a vent is less than the corresponding cross-section for the embodiment shown in FIG. 1.

Figure 3:
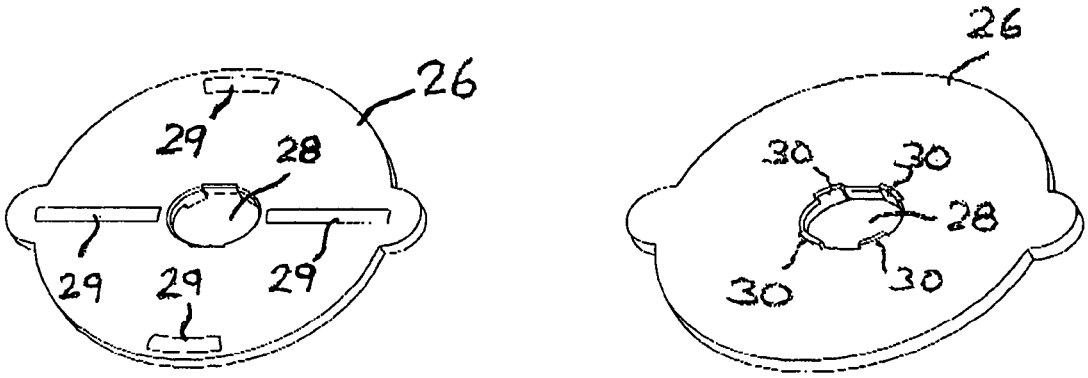
FIG. 3 is a perspective view of an end-plate according to the invention.

FIG. 3 shows an end plate 26 containing the hole 28. Protrusions 30 are provided at the hole 28 for engagement with the at least second flange 22 while the at least first flange 20 engages with the side of the end plate 26 opposite the protrusions 30 whereby rotational movement of the adaptor 10 in the hole 28 is prevented. The end-plate 26 also has raised portions 29 facilitating correct positioning of the adaptor in relation to the hole 28 and for supporting the end-plate resting on a surface and accommodating the adaptor 10.

Figure 4:
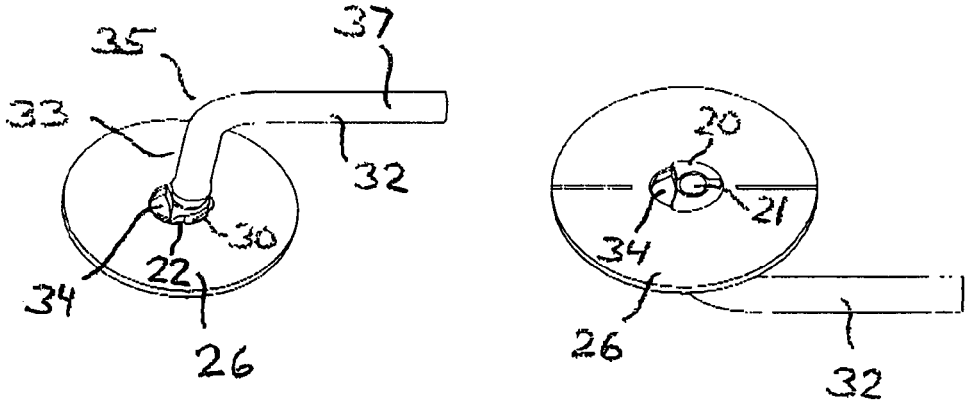
FIG. 4 shows attachment according to the invention of an adaptor to an end-plate and a sound tube.

FIG. 4 illustrates assembly of the sound tube 32 with the sound tube adaptor 10 and the end plate 26. The sound tube 32 has a first straight portion 33, a first bend 35, and a second straight portion 37. When the shell is positioned in the user's ear, the first portion 33 is substantially horizontal and the second portion 37 is substantially vertical.

It should be noted that the cross-section of the adaptor 10 at its second end 18 has a cross-section that is less than the corresponding cross-section of the end-plate hole 28, so that an area 34 of the hole, after insertion of the adaptor 10, functions as a vent 34.

As further illustrated in FIG. 4, the at least second flange 22 is adapted to engage with the protrusions 30 provided at the hole 28 for prevention of rotational movement of the adaptor 10 in the hole 28.

The first end 12 of the adaptor 10 with its bead 16 is inserted into the sound tube 32 for secure attachment by resilience of the sound tube 32.

Figure 5:
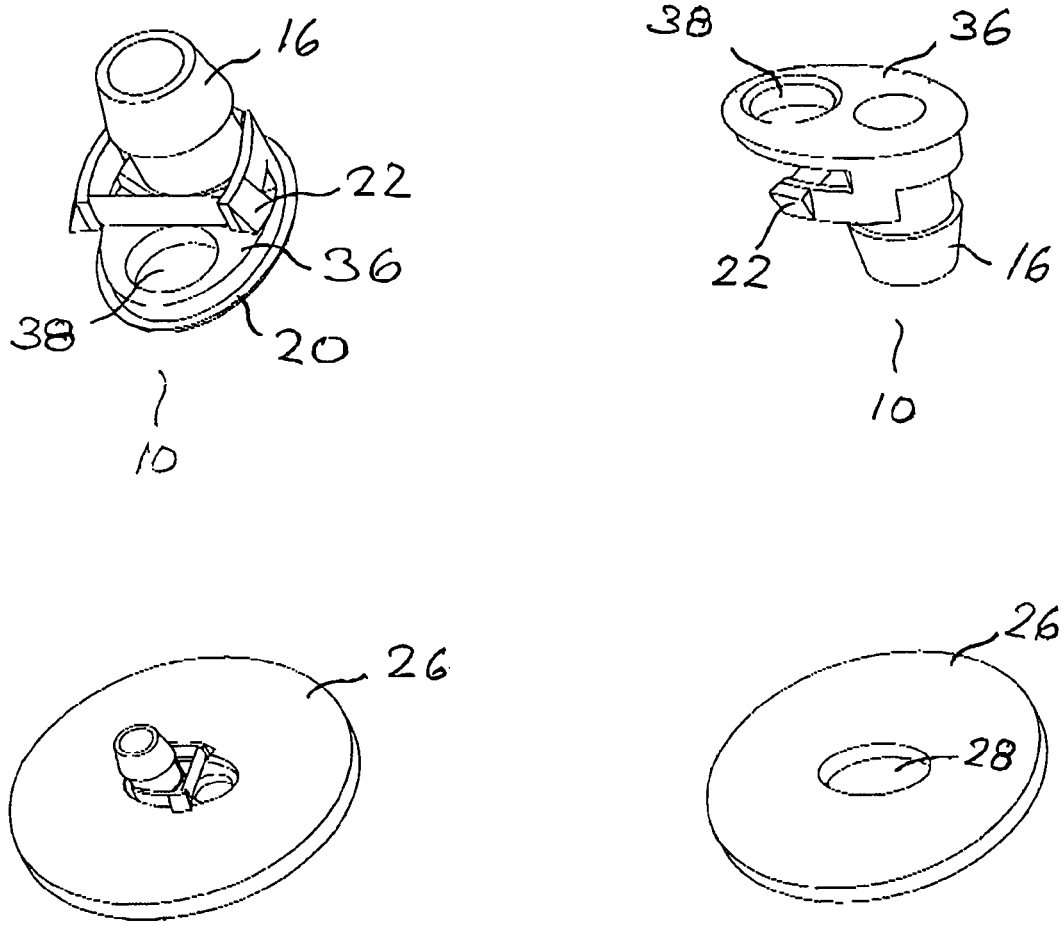
FIG. 5 is a perspective view of a third embodiment of the invention.

FIG. 5 illustrates yet another embodiment of the invention, wherein the sound tube adaptor 10 further comprises an end-plate 36 at the second end 18 having a vent hole 38. In the shown embodiment, the end plate 36 has a generally oval shape fitting the oval shape of the end-plate hole 28. It should be noted that after insertion of the adaptor 10 in the end-plate hole 28, the at least one first flange 20 and the at least one second flange 22 engage with respective opposite sides of the end plate 26 for secure attachment of the adaptor 10 in the hole 28.

It should also be noted that the at least second flange 22 are tapered along the longitudinal axis 14 of the adaptor 10 towards the first end 12 whereby the adaptor 10 is inserted into the end-plate hole 28 by a snap fit coupling.

Figure 6A:
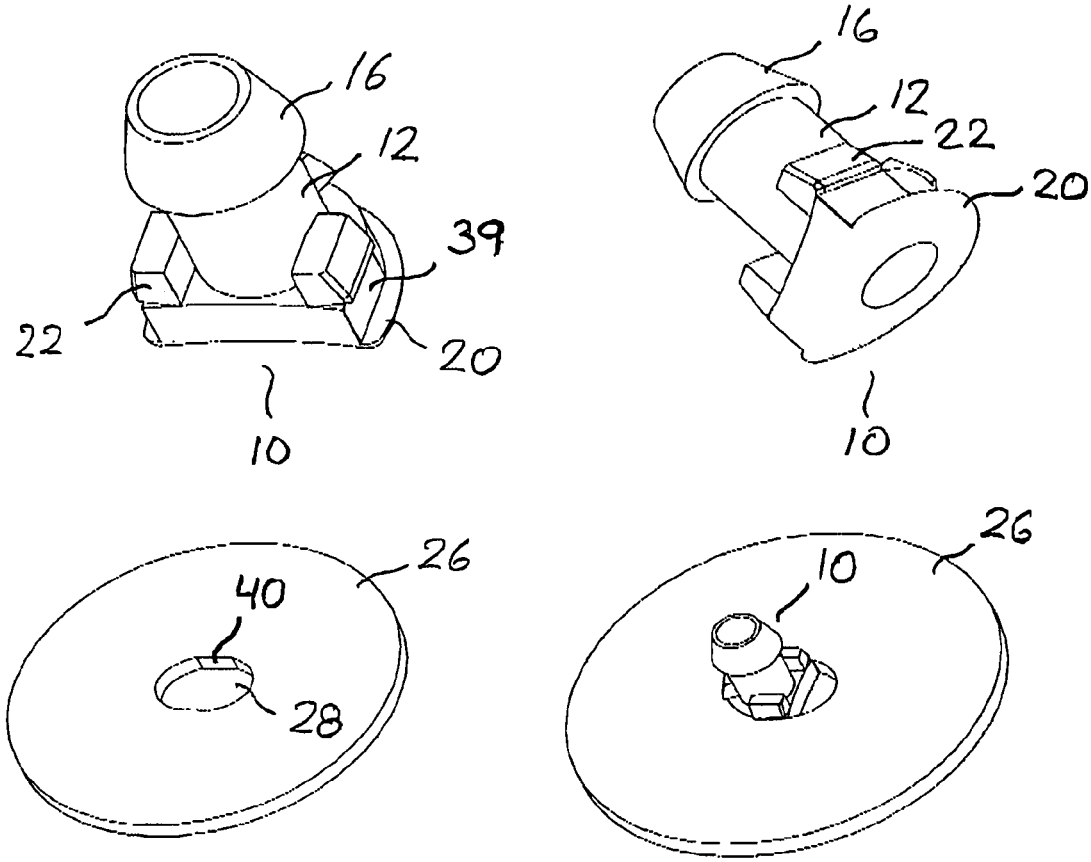
FIG. 6A is a perspective view of a fourth embodiment of the invention.

FIG. 6A illustrates still another embodiment of the invention that corresponds to the embodiment shown in FIG. 1, however the generally oval circumference of the adaptor 10 and the hole 28 of the embodiment of FIG. 1 further contains linear segments 39, 40, respectively, for fixed attachment of the adaptor 10 in the hole 28.

Figure 6B:
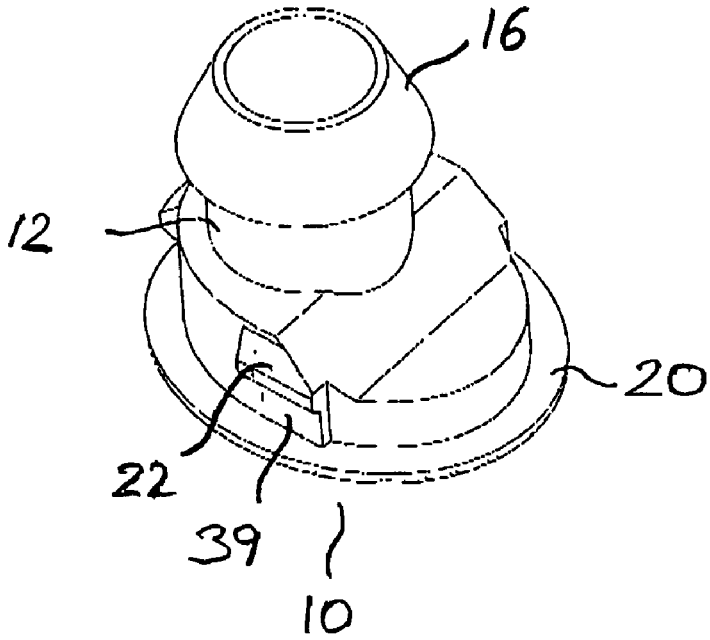
FIG. 6B is a perspective view of a fifth embodiment of the invention.
Figure 6B:
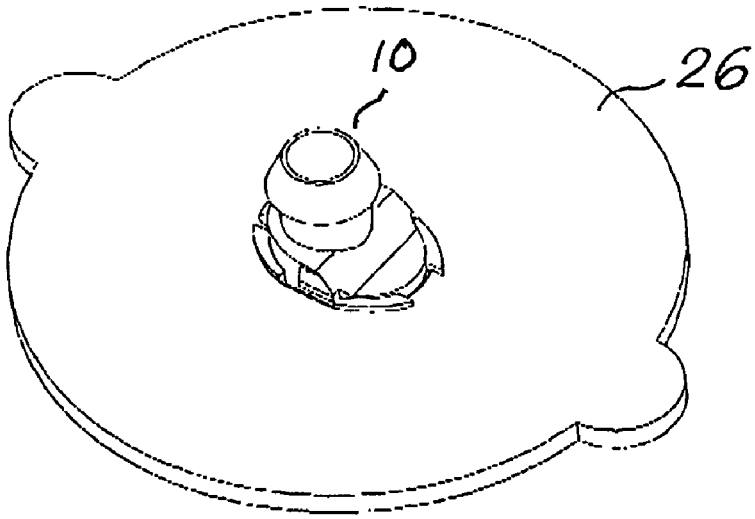

FIG. 6B illustrates an embodiment wherein the cross-section of the second end of the adaptor 10 corresponds to the hole 28 in the shell or the shell end-plate in such a way that after insertion of the adaptor 10 in the hole 28 there is no un-obstructed part of the hole 28, i.e. the adaptor 10 according to this embodiment does not cooperate with the hole 28 to form a vent.

Figure 7:
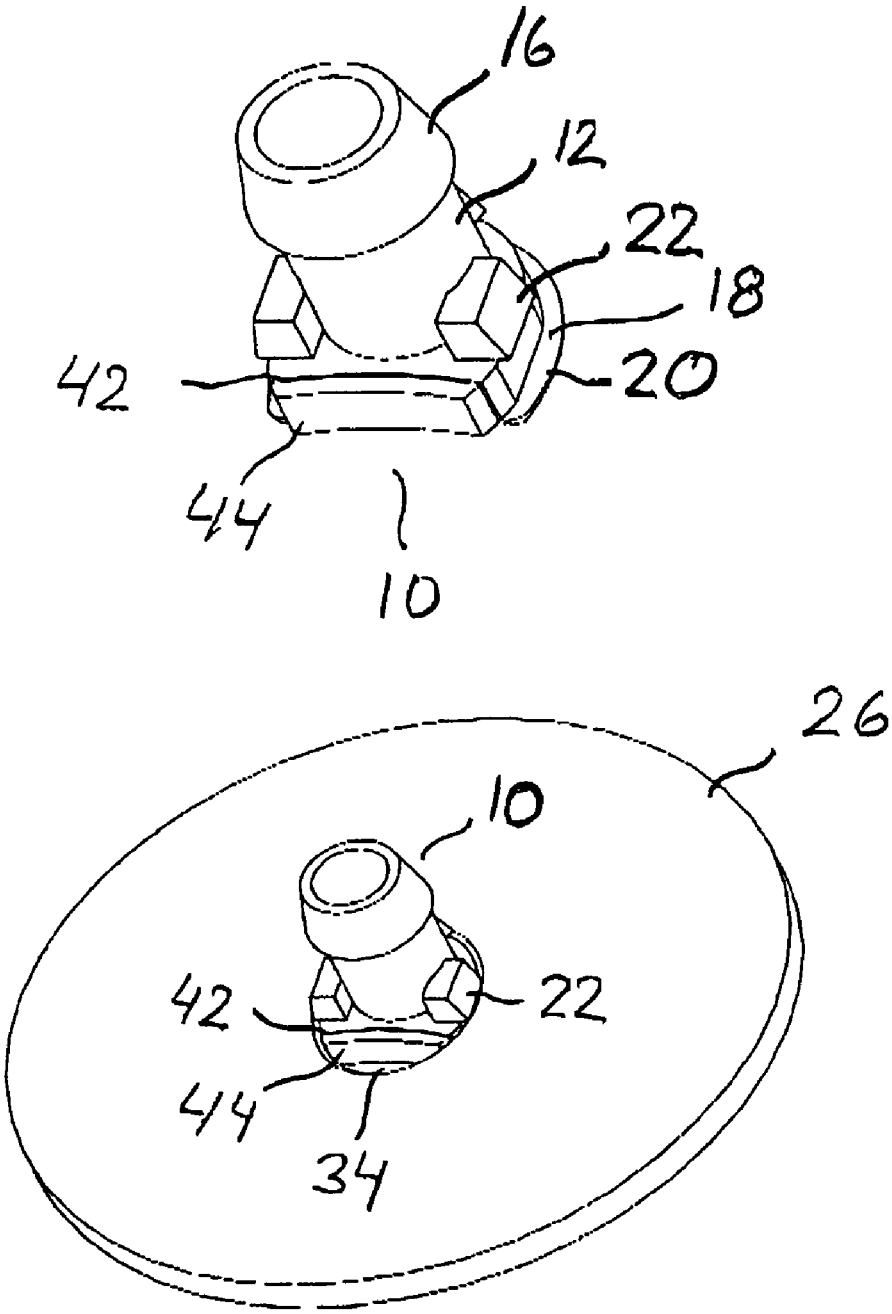
FIG. 7 is a perspective view of a sixth embodiment of the invention.

In the embodiment shown in FIG. 7, the sound tube adaptor 10 further contains weakenings 42 at the second end 18 allowing removal of a part 44 of the adaptor 10 for obstruction of a smaller part 34 of the hole 28 in the shell or end plate 26 after insertion of the adaptor 10.

Figure 8:
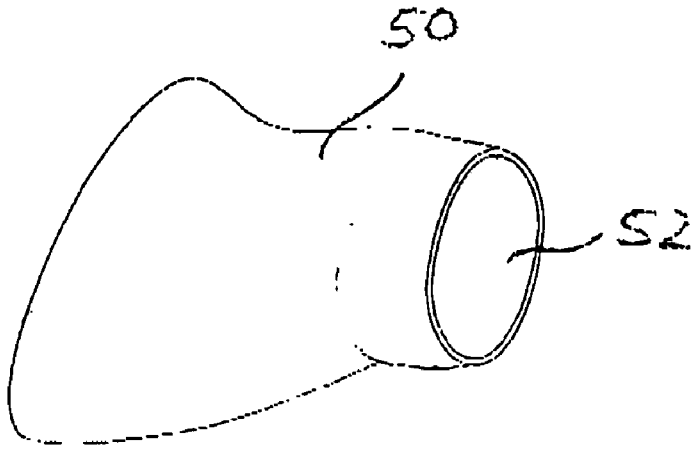
FIG. 8 is a perspective view of an open shell without an end-plate.

FIG. 8 illustrates a hollow shell 50 with an aperture 52 for reception of the end plate 26.

Figure 9:
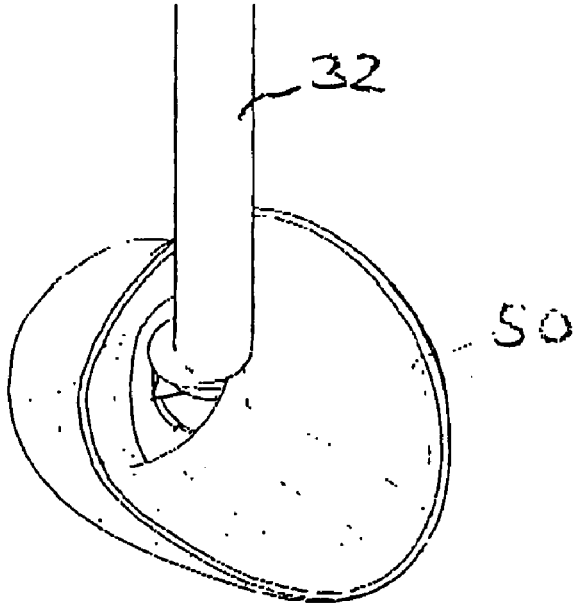
FIG. 9 is a perspective view of the open shell with the adaptor and sound tube.
Figure 10:
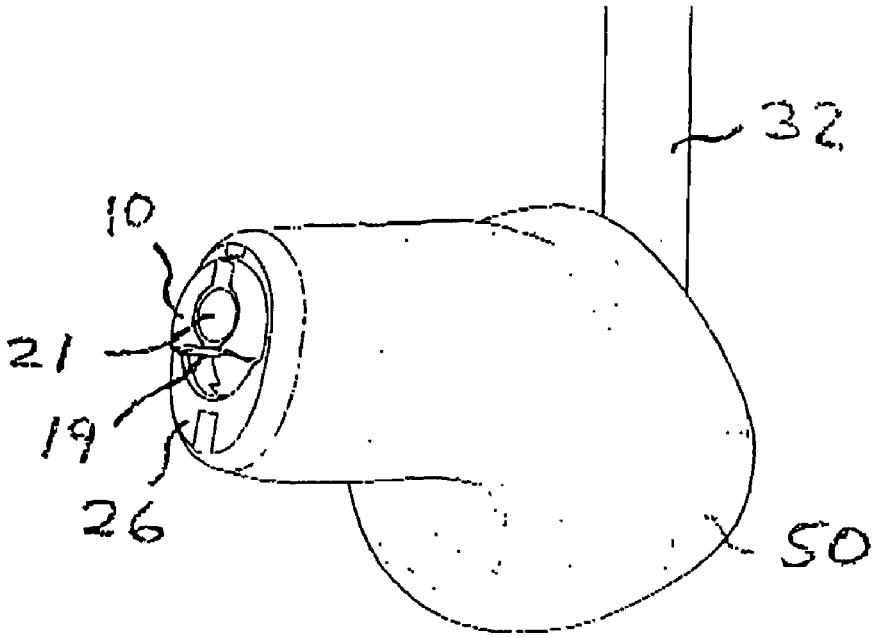
FIG. 10 is another perspective view of the open shell with the adaptor and sound tube.
Figure 11:
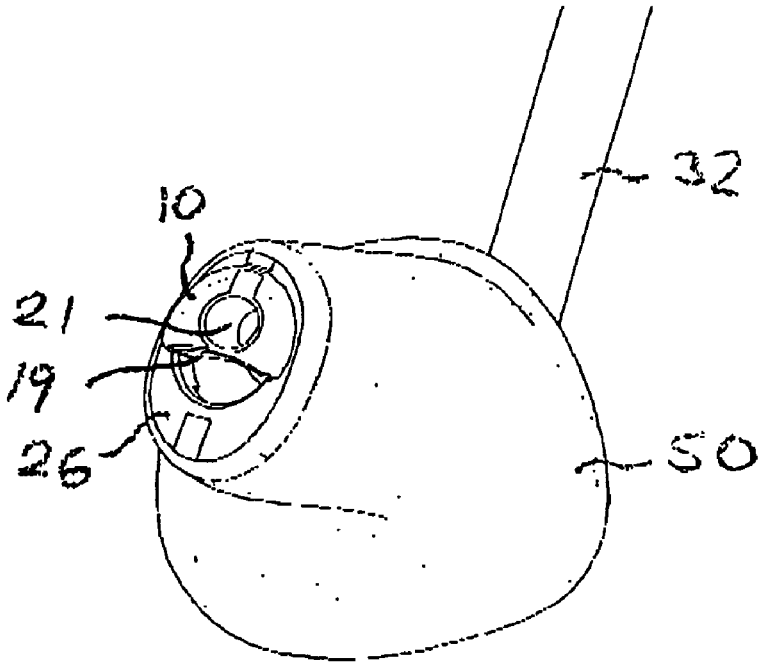
FIG. 11 is yet another perspective view of the open shell with the adaptor and sound tube.

FIGS. 9-11 show various perspective views of the assembled shell ready for mounting in the user's ear.

Figure 12:
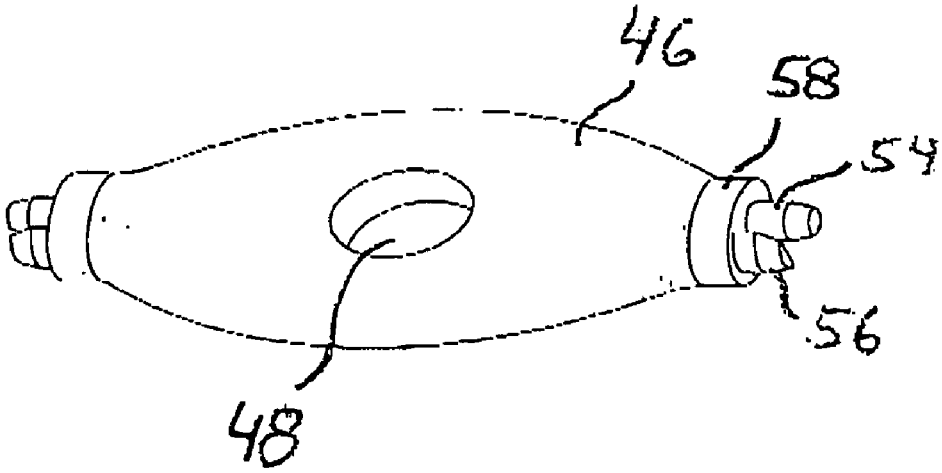
FIG. 12 is a perspective view of a tool for inserting the adaptor into the hole of the shell.

FIG. 12 shows a tool 46 for insertion of the adaptor 10 with a sound tube 32 into the end-plate hole 28. The tool 46 has a center hole 48 for checking that the adaptor assembly may be used for a particular shell 50. If the cross-section of the aperture 52 covers the center hole 48, the shell 50 has a sufficient size for accommodating an adaptor 10. Likewise, if the end 58 of the tool can enter the opening 52 of the shell 50, the shell 50 has a sufficient size for accommodating an adaptor 10. The protrusion 54 is adapted for insertion into output opening 21 of the adaptor 10, and the space between the flat protrusion 56 and the round protrusion 54 is adapted to accommodate the cut side 19 of the adaptor 10.

Figure 13:
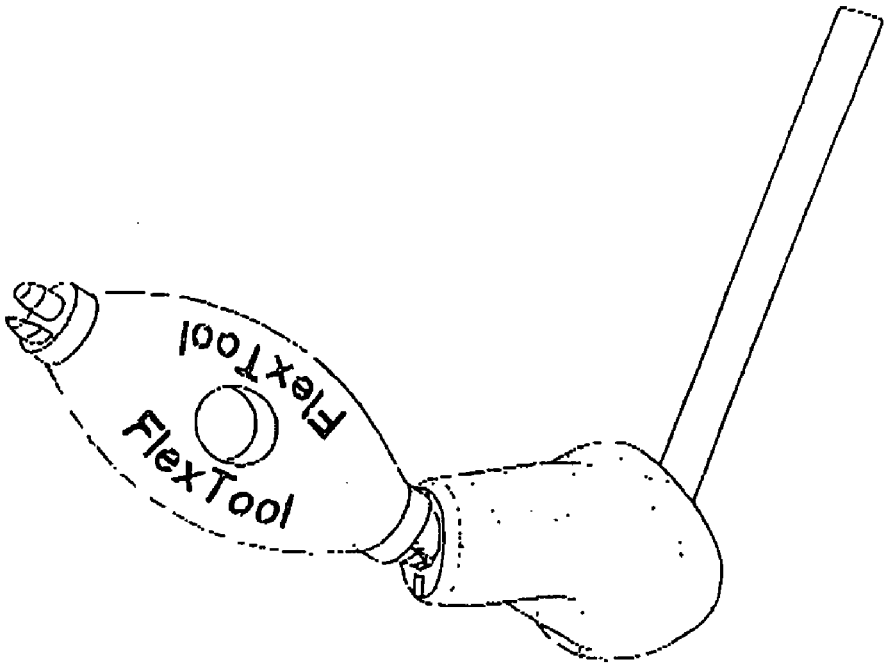
FIG. 13 illustrates operation of the tool for insertion of the adaptor.
Figure 14:
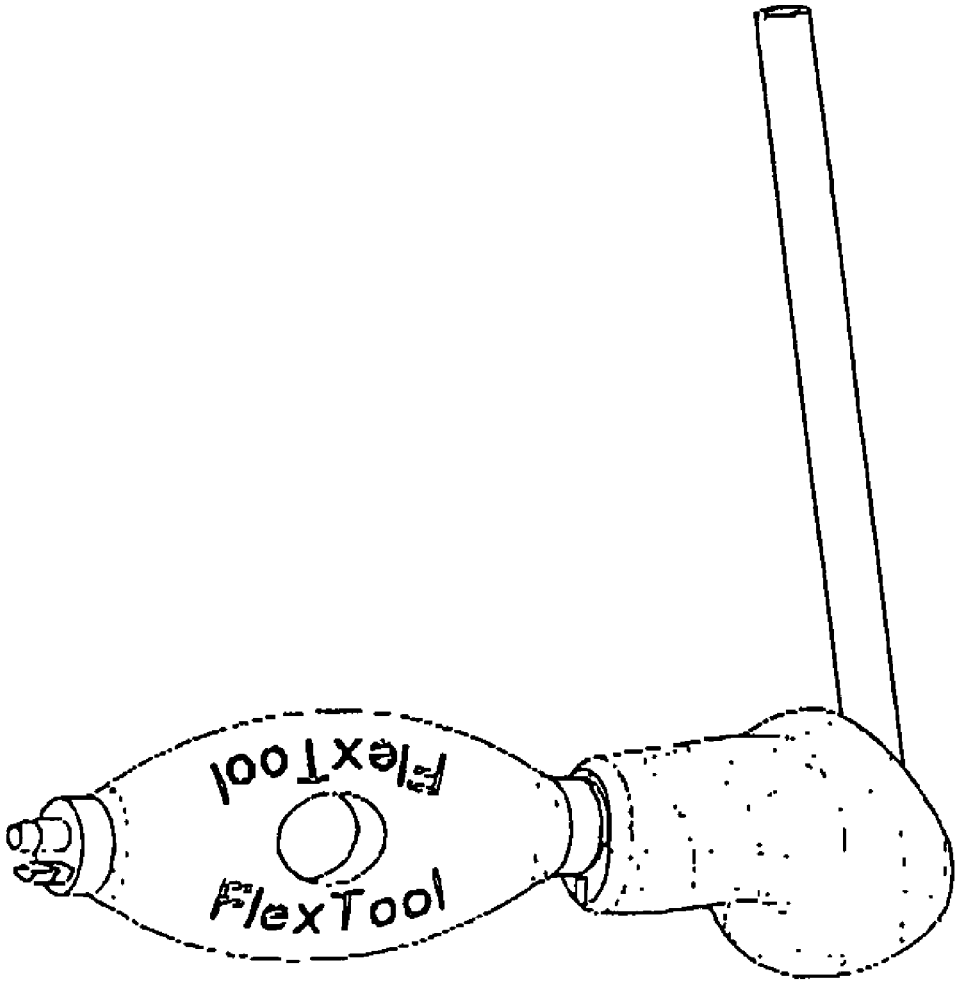
FIG. 14 illustrates the position of the tool immediately before removal of the tool.

During insertion with the tool 46, the adaptor 10 with the sound tube is removably attached to the tool 46 by insertion of the round protrusion 54 into the adaptor opening 21 and accommodation of the cut side 19 of the adaptor between the protrusions 54, 56. The sound tube 32 is then inserted into the end-plate hole 28 until the tool 46 abuts the end plate 26. As shown in FIG. 13, the tool 46 is angled in relation to the end plate so that the flanges opposite the cut side 19 of the adaptor 10 engage with the edge of the hole 28. Upon engagement, the tool is moved to the position shown in FIG. 14, and the adaptor snaps into its position in the hole by engagement of further flanges. Finally, the tool is removed. The adaptor 10 may be removed from the shell 50 by performing the above-mentioned steps in the opposite order.

The invention claimed is:

1. A sound tube adaptor for facilitating attachment of a sound tube to a hollow shell of a hearing aid, the hollow shell having a wall defining a cavity, the sound tube adaptor comprising:

a first end for attachment to one end of the sound tube, a second end that is configured to be received in a hole in the wall of the shell, at least one first flange at the second end for abutment with an outer surface of the shell after insertion of the adaptor in the hole, and at least one second flange positioned at a distance from the at least one first flange along a longitudinal axis of the adaptor, the distance being approximately equal to a thickness of the wall at the hole, wherein the at least one second flange is for abutment with an inner surface of the wall of the shell after insertion of the adaptor in the hole, and wherein the at least one second flange is resilient to allow the at least one second flange to pass through the hole and subsequently expand beyond the circumference of the hole.

2. The adaptor according to claim 1, wherein the adaptor and the hole co-operate to provide at least one vent when the adaptor is inserted in the hole.

3. The adaptor according to claim 1, wherein the first end has a generally cylindrical shape extending along the longitudinal axis and a bead at the first end for insertion into the sound tube for secure attachment by resilience of the sound tube.

4. The adaptor according to claim 1, wherein the second end for attachment to the shell has a generally cylindrical shape, and wherein the cross-section of the adaptor at the second end has a cross-section that is less than a corresponding cross-section of the hole, so that an unobstructed area of the hole, after insertion of the adaptor, may function as a vent.

5. The adaptor according to claim 1, wherein the at least second flange is tapered along the longitudinal axis towards the first end whereby the adaptor may be fixed in the hole by a snap fit coupling.

6. The adaptor according to claim 1, wherein the at least second is configured for engagement with protrusions provided at the shell for prevention of a rotational movement of the adaptor in the hole.

7. The adaptor according to claim 1, wherein the wall at the hole is implemented as an end plate.

8. The adaptor according to claim 1, further containing weakenings at the second end allowing removal of part of the adaptor for obstruction of a smaller part of the hole in the shell after insertion of the adaptor.

9. A method of attaching a sound tube to a shell comprising the steps of:

attaching one end of the sound tube to an adaptor, wherein the adaptor comprising:

a first end for attachment to one end of the sound tube, a second end that is configured to be received in a hole in shell, at least one first flange at the second end for abutment with an outer surface of the shell after insertion of the adaptor in the hole, and at least one second flange positioned at a distance from the at least one first flange along a longitudinal axis of the adaptor, the distance being approximately equal to a thickness of the hole, wherein the at least one second flange is for abutment with an inner surface of the shell after insertion of the adaptor in the hole, and configured to fix the adaptor in the hole by a snap fit coupling putting the first end through the hole;

inserting the other end of the sound tube into a hole in the shell from the outside of the shell passing the sound tube and the first end of the adaptor through the hole; and mounting the adaptor in the hole whereby the sound tube is attached to the shell.

10. The method of claim 9, wherein the mounting of the adaptor comprises a snap fit coupling of the adaptor to the hole.

11. An apparatus comprising:

a sound tube adaptor having a first end and a second end; and a hollow shell having a first end, a second end for facing the eardrum when the shell has been inserted into the ear canal of a user, and a shell wall defining a cavity extending between the first and the second ends of the shell and having a volume that is larger than the volume occupied by the sound tube adaptor, wherein the first end of the sound tube adaptor is configured to be attached to an end of a sound tube, and the second end of the sound tube adaptor is configured to be snap fit coupled to a hole in the shell wall at the second end of the shell putting the first end of the adaptor through the hole, and wherein the shell accommodates the first end of the sound tube adaptor with the sound tube when the sound tube adaptor has been snap fit coupled to the hole in the shell wall.

12. The apparatus of claim 11, wherein the sound adaptor has at least one first flange at the second end for abutment with an outer surface of the shell after insertion of the adaptor in the hole, and at least one second flange positioned at a distance from the at least one first flange along a longitudinal axis of the adaptor, the distance being approximately equal to a thickness of the shell wall at the hole, wherein the at least one second flange is for abutment with an inner surface of the shell after insertion of the adaptor in the hole, and wherein the at least second flange is tapered along the longitudinal axis towards the first end.

13. The apparatus of claim 11, wherein the shell includes an end plate containing the hole.

14. The apparatus of claim 11, wherein the shell includes a vent.

15. The apparatus of claim 11, wherein the adaptor includes a vent.

16. The apparatus of claim 11, wherein the second end of the adaptor for attachment to the shell has a generally cylindrical shape, and wherein the cross-section of the adaptor at the second end has a cross-section that is less than a corresponding cross-section of the hole, so that an unobstructed area of the hole, after insertion of the adaptor, may function as a vent.

17. The apparatus of claim 11, wherein a major portion of the shell has a shell thickness that is substantially uniform.

18. An apparatus comprising a hollow shell of a hearing aid, the hollow shell having a wall defining a cavity, and a sound tube adaptor for facilitating attachment of a sound tube to the shell, the adaptor having a first end for attachment to one end of the sound tube; and a second end that is configured to be received in a hole in the wall of the shell;

at least one first flange at the second end for abutment with an outer surface of the shell after insertion of the adaptor in the hole; and at least one second flange positioned at a distance from the at least one first flange along a longitudinal axis of the adaptor, the distance being approximately equal to a thickness of the wall at the hole, wherein the at least one second flange is for abutment with an inner surface of the wall of the shell after insertion of the adaptor in the hole; and wherein the at least one second flange is resilient and tapered along the longitudinal axis towards the first end to allow the at least one second flange to pass through the hole and subsequently expand beyond the circumference of the hole.

* * * * *